US008258707B2

(12) United States Patent
Van Der Veen et al.

(10) Patent No.: US 8,258,707 B2
(45) Date of Patent: Sep. 4, 2012

(54) LIGHTING DEVICE WITH A LED USED FOR SENSING

(75) Inventors: Geert Willem Van Der Veen, Eindhoven (NL); Johan Wilhelmus Hermanus Kuppen, Eindhoven (NL); Marco Foggi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 239 days.

(21) Appl. No.: 12/595,646

(22) PCT Filed: Apr. 15, 2008

(86) PCT No.: PCT/IB2008/051426

§ 371 (c)(1),
(2), (4) Date: Oct. 13, 2009

(87) PCT Pub. No.: WO2008/129453

PCT Pub. Date: Oct. 30, 2008

(65) Prior Publication Data

US 2010/0117543 A1 May 13, 2010

(30) Foreign Application Priority Data

Apr. 20, 2007 (EP) ..... 07106600

(51) Int. Cl.
*H05B 37/02* (2006.01)

(52) U.S. Cl. ..... 315/149; 315/246; 315/360

(58) Field of Classification Search ..... 315/149, 315/150, 151, 158, 246, 291, 308, 312, 324, 315/360; 250/206, 552
See application file for complete search history.

(56) References Cited

U.S. PATENT DOCUMENTS

| | | | | |
|---|---|---|---|---|
| 6,144,165 | A | 11/2000 | Liedenbaum | |
| 6,617,560 | B2 * | 9/2003 | Forke | 250/205 |
| 7,015,654 | B1 * | 3/2006 | Kuhlmann et al. | 315/291 |
| 7,040,773 | B1 | 5/2006 | Zincone et al. | |
| 7,088,261 | B2 | 8/2006 | Sharp et al. | |
| 7,394,211 | B1 * | 7/2008 | Kuhlmann | 315/291 |
| 2006/0273985 | A1 * | 12/2006 | Sun et al. | 345/46 |

FOREIGN PATENT DOCUMENTS

EP 1701589 A1 9/2006

OTHER PUBLICATIONS

Dietz et al: "Very Low-Cost Sensing and Communication Using Bidirectional LEDs"; Mitsubishi Electric Research Laboratories, TR2003-35, Jul. 2003, 19 Page Document.
EPE Magazine: "Light Detector"; Jan. 2005 Issue of EPE Online, Techbites Interactive, Inc., Retrieved From www.epemag.com/0105p2.html on Oct. 25, 2006, 1 Page Document.

* cited by examiner

*Primary Examiner* — Thuy Vinh Tran
(74) *Attorney, Agent, or Firm* — Mark L. Beloborodov

(57) ABSTRACT

A lighting device (10) comprises a LED (4), a driver (3), and a controller (2) which regularly switches from a drive state to a measuring state and back. In the measuring state, the controller controls the driver such that the driver does not generate any LED current. The LED produces a measuring signal (Sm) indicating a measured light level. The controller processes the measuring signal received from the LED, and makes a decision on the desired light output of the LED. In the drive state, the controller controls the driver such that the average light output produced by the LED corresponds to the desired light output as determined in the measuring state. In a possible embodiment, the driver generates a nominal LED current $I_{NOM}$, and sets the duration ($\tau$1) of the drive state on the basis of the desired light output of the LED as determined in the measuring state.

8 Claims, 4 Drawing Sheets

LIGHTING DEVICE WITH A LED USED FOR SENSING

FIELD OF THE INVENTION

The present invention relates in general to the field of lighting devices, more particularly to lighting devices in which one or more LEDs are used for generating light.

BACKGROUND OF THE INVENTION

As embodiment of electrically powered light source, an LED is a relatively recent development since the incandescent lamp and the gas discharge lamp. Although LEDs are known for use as indicator for a relatively long time, typically as POWER ON indicator in a consumer appliance, a rather recent development is the use as illumination light source, which became possible with the development of power LEDs. LEDs are nowadays used for ambiance lighting, for signaling (traffic lights and the like), and even for tail lights, brake lights and head lights of automobiles.

SUMMARY OF THE INVENTION

Light sources can be controlled in response of a user action, for instance a user actuating a switch, or automatically in response to some external event or condition, in which case an event detector or condition sensor is needed. A specific example is ambient light level: it may be desirable to adapt the light output of a light source in dependency of the ambient light level. For instance, during the day, a traffic light needs to have a relatively high light output in order to be visible at some distance, but during the night the light output of the traffic light may be reduced. Thus, a sensor is needed for sensing the ambient light level.

In another example, master/slave behavior of illumination may be desirable. In a relatively large area which is illuminated by several light sources, it may be cumbersome for the user to have to switch on all light sources individually, while it is not always possible or desirable to connect all light sources to one switch. Additional control wires for multiple luminaires are expensive, in particular when an existing lighting system is upgraded to a controllable system and additional wiring is required. As a solution, it may be possible to provide each light source with a light sensor: as soon as the sensor senses that another light source is switched on, it may switch on its associated light source.

For applications of the above or similar type, it would be customary to have separate sensors. However, sensors add to the costs of such application.

An object of the present invention is to provide the same functionality at reduced costs.

According to an important aspect of the present invention, an LED is used as a light source as well as a light sensor.

Further advantageous elaborations are mentioned in the dependent claims.

It is noted that it is known per se that an LED has a property of photosensitivity so that it is possible that an LED is used as a light sensor. For instance, reference is made to U.S. Pat. No. 6,617,560. However, in this document the LED used for light sensing is exclusively used for light sensing: it is not used for light production. In contrast, according to the present invention, an LED is advantageously used for light sensing as well as for light production.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
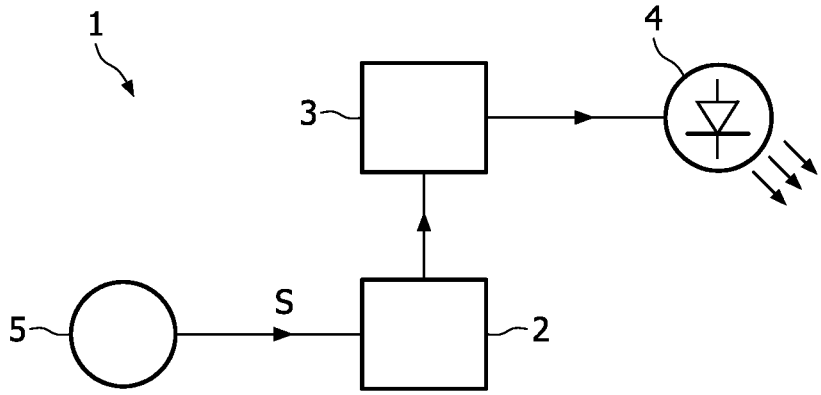
FIG. 1 is a block diagram schematically showing an illumination device.

FIG. 1 is a block diagram schematically showing an illumination device 1, comprising at least one LED 4. Current for the LED 4 is provided by a LED driver 3, which is controlled by a controller 2 on the basis of a sensor signal S received from a light sensor 5 at a sensor input of the controller 2.

Figure 2:
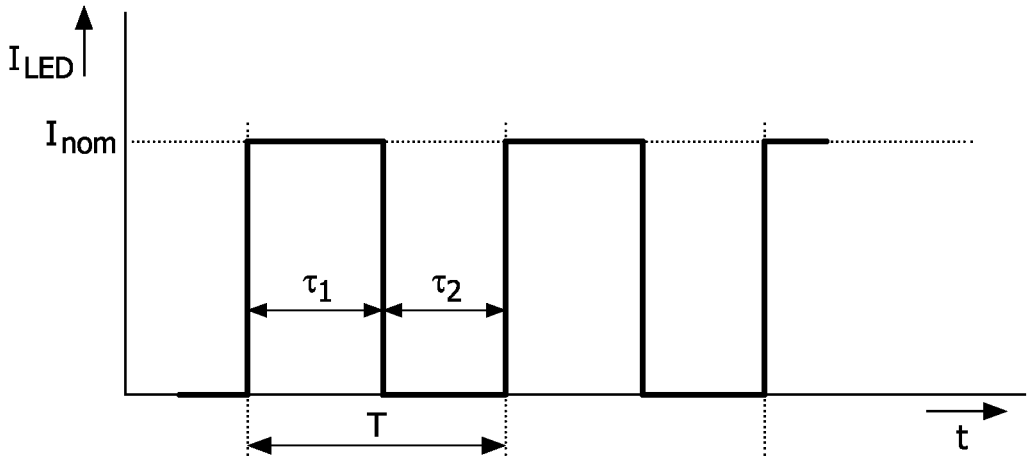
FIG. 2 is an exemplary graph schematically illustrating LED current as a function of time.

FIG. 2 is a graph schematically illustrating LED current $I_{LED}$ (vertical axis) as a function of time (horizontal axis), in order to show a possible implementation of dimming by means of PWM or duty cycle control. The LED is either ON or OFF, with the current having a nominal value $I_{NOM}$ or zero, respectively. The current is switched on a regular basis from $I_{NOM}$ to zero and back. The LED is ON during a time interval $\tau 1$, and OFF during a time interval $\tau 2$. A current period T is defined as $T=\tau 1+\tau 2$, a current frequency f is defined as $f=1/T$. A duty cycle $\Delta$ is defined as $\Delta=\tau 1/T$.

The controller 2 controls $\tau 1$ and $\tau 2$. Normally, T is kept constant, for instance at a value of about 600 Hz. By setting the duty cycle $\Delta$, the average LED current and hence the average light intensity produced by the LED can be set, as will be clear to a person skilled in the art.

In the state of the art, as illustrated in FIG. 1, the light sensor 5 is a separate sensor. According to the present invention, the LED 4 itself can also be used as light sensor.

Figure 3:
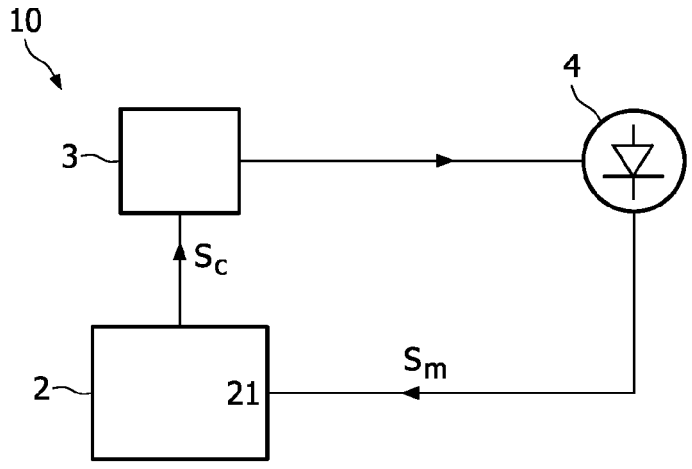
FIG. 3 is a block diagram schematically showing an illumination device according to the present invention.

FIG. 3 is a block diagram schematically showing an illumination assembly 10 according to the present invention. As compared to FIG. 1, the separate light sensor 5 is omitted and the LED 4 is coupled to a sensor input 21 of the controller 2. The controller 2 is capable of operating in a drive state and in a measuring state. The controller 2 is adapted, during operation, to frequently switch from its drive state to its measuring state and back. The switching may be done regularly or irregularly, regularly being preferred.

Figure 4A:
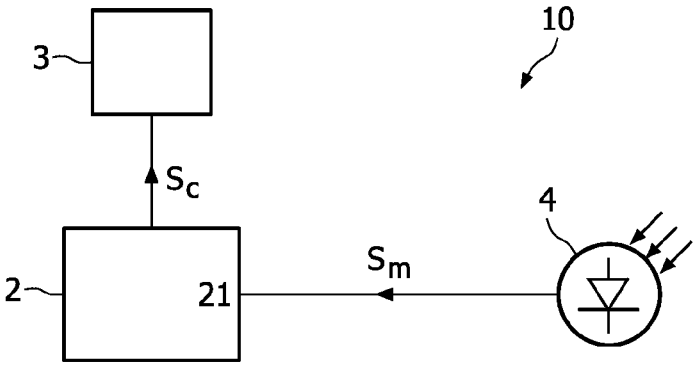
FIG. 4A is a block diagram comparable to FIG. 3, schematically illustrating a measuring state.

The operation is as follows. During a measuring state, illustrated in FIG. 4A, the controller 2 generates its control signal Sc for the driver 3 such that the driver does not generate any LED current; the LED is OFF. The LED generates a photocurrent Sm, which is received by the controller 2 at its sensor input 21 and which is indicative of a light intensity sensed by the LED. The controller 2 processes the input signal Sm and makes a decision on the desired light output of the LED 4.

Figure 4B:
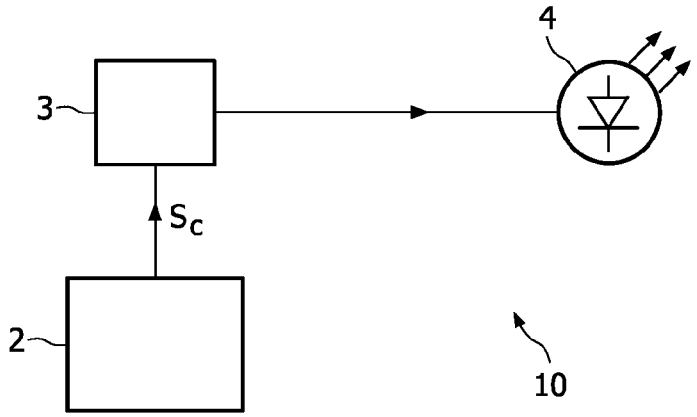
FIG. 4B is a block diagram comparable to FIG. 3, schematically illustrating a drive state.

Then, the controller 2 switches to its drive state. During the drive state, illustrated in FIG. 4B, the controller 2 generates its control signal Sc for the driver 3 such that the driver generates LED current $I_{NOM}$; the LED is ON. The LED output signal Sm during this state is not a measure of light intensity sensed by the LED, and may be ignored by the controller 2. In order to assure that the average light output of the LED corresponds to the desired light output as determined on the basis of the measuring signal Sm in the measuring state, the controller sets the duration $\tau 1$ of the drive state to a suitable value. For instance, if continuous driving of the LED at current level $I_{NOM}$ would result in a light output Lmax, while the desired light output is indicated as Ld (lower than Lmax), the controller 2 may set the duration $\tau 1$ of the drive state equal to $\tau 1=(Ld/Lmax)\cdot T$, wherein the LED current frequency $f=1/T$ is kept constant.

It follows that the duration of the measuring state fulfils $\tau 2=T-\tau 1$, and is reduced with increasing light output. For obtaining a reliable measuring result, the duration of the measuring state should be larger than a certain minimum duration $\tau_{MIN}$. In practice, $\tau_{MIN}$ may be about 100 μs. This corresponds to a maximum allowable value for $\tau 1$, and hence a maximum obtainable value for the light output lower than Lmax. In practice, this is acceptable. However, if a higher light output is desirable, it is possible to reduce the LED current frequency, or it is possible that the measuring state is not included in every current period. For instance, if a light output of 0.93·Lmax is desired, and the minimum duration $\tau_{MIN}$ is equal to 0.1·T, it is possible to alternate current periods having duty cycle $\Delta=0.9$ (including a measuring state) with current periods having duty cycle $\Delta=0.96$ (without a measuring state).

Figure 5A:
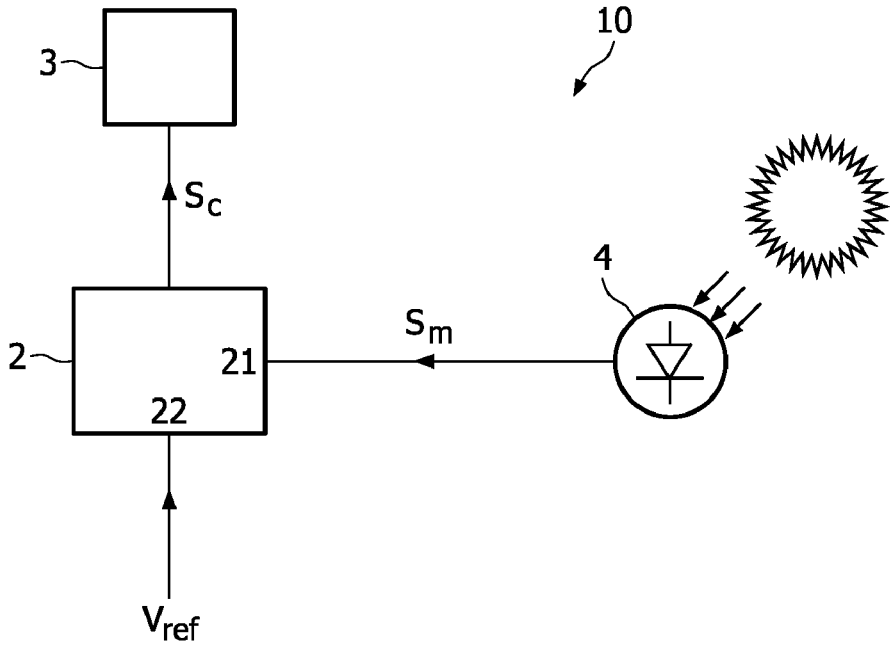
FIG. 5A is a block diagram comparable to FIG. 4A, schematically illustrating a particular embodiment.

In a possible embodiment, illustrated in FIG. 5A, the assembly 10 is implemented as an adaptive signaling light, for instance a traffic light. The controller 2 may have a reference input 22 receiving a reference value Vref. The controller 2 compares the measuring signal Sm with the reference value Vref. In dark circumstances, the measuring signal Sm will be relatively low; in such situation, the controller 2 will set the duration $\tau 1$ of the drive state at a relatively low value, for instance equal to 0.45·T, so that the LED is operated at a duty cycle $\Delta=45\%$. In bright daylight, the measuring signal Sm will be relatively high; in such situation, the controller 2 will set the duration $\tau 1$ of the drive state at a relatively high value, for instance equal to 0.90·T, so that the LED is operated at a duty cycle $\Delta=90\%$. As a result, the light output of the signaling light is reduced by 50% during dark circumstances.

Figure 5B:
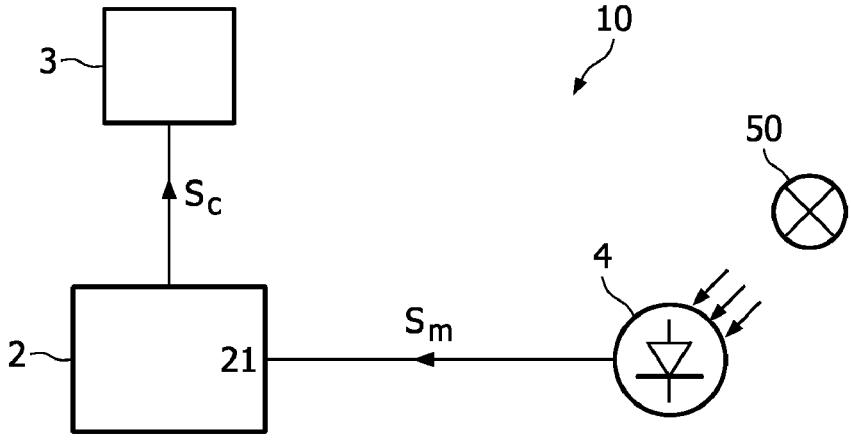
FIG. 5B is a block diagram comparable to FIG. 4A, schematically illustrating a particular embodiment.

In a possible embodiment, illustrated in FIG. 5B, the assembly 10 is implemented as an automatically switching illumination system, responsive to other light sources 50. The measuring signal Sm indicates whether such other light source 50 is ON or OFF. If the measuring signal Sm indicates that such other light source 50 is ON, the controller 2 will set the duration $\tau 1$ of the drive state at a predetermined value, for instance equal to 0.90·T, so that the LED is ON at a certain predetermined light output. If the measuring signal Sm indicates that such other light source 50 is OFF, the controller 2 will set the duration $\tau 1$ of the drive state to be equal to zero, so that the LED is OFF. As a result, the light output of the illumination system is automatically switched ON or OFF, following the other light source 50 being switched ON or OFF, respectively.

The other light source may for instance be public street lighting, and the assembly 10 may be part of an illumination system illuminating parts of a house or a garden. If the public street lighting is switched ON, the illumination system is automatically switched ON as well.

The other light source 50 may in turn also be implemented in accordance with the present invention. Thus, it is possible to provide a group of LEDs which are all automatically switched ON or OFF in response to a first light source being switched ON or OFF, respectively (master/slave configuration). All LEDs may be responsive to one common first light source, or the LEDs may be arranged in a serial arrangement so that each LED is responsive to a preceding LED in the series. The first light source may be switched manually by a user, or may be switched by a timer.

The LED 4 and the other light source 50 may be integrated in one common luminaire. For instance, the other light source 50 may be a TL lamp in a hybrid luminaire: when the TL lamp is switched ON, the LED(s) is/are automatically switched ON as well.

The controller 2 may distinguish artificial light sources (such as public street lighting) from sun light in view of the fact that the artificial light sources will typically be modulated (mains: 100 Hz, or HF modulation).

The light of the other light source 50 may be modulated according to some digital protocol in order to communicate data. The controller 2 will follow this modulation so that the light from the LED 4 is likewise modulated; in that case, the assembly 10 acts effectively as a repeater for the data.

Figure 5C:
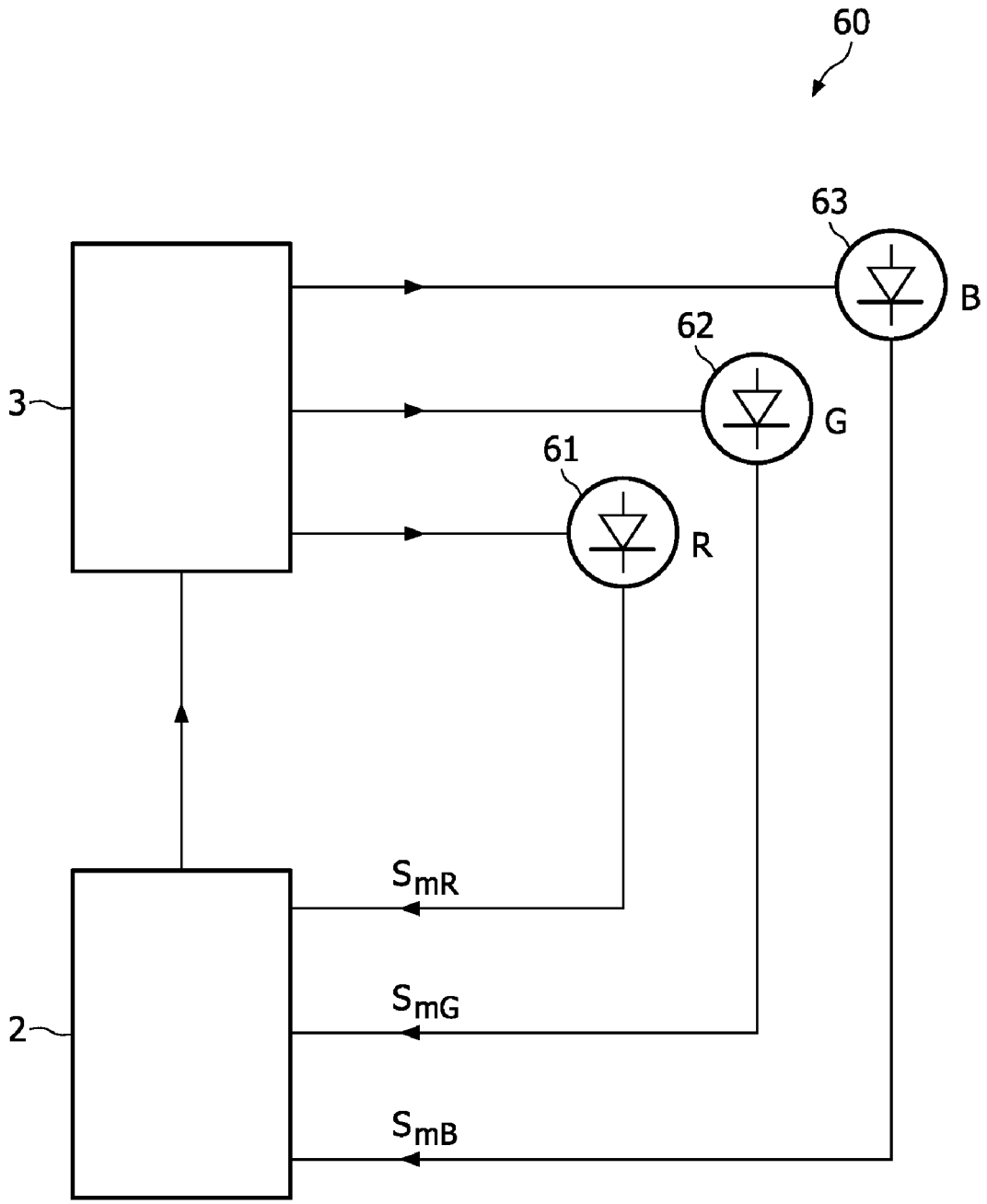
FIG. 5C is a block diagram comparable to FIG. 3, schematically illustrating a particular embodiment.

In a possible embodiment, illustrated in FIG. 5C, the assembly 60 is color sensitive. Instead of only one LED 4, the assembly comprises a plurality of different LEDs, having mutually different design so that they emit mutually different color. Then, also their photo sensitivities are mutually different; if the number of different LEDs is at least equal to three, these LEDs can sense the color point of the light.

In FIG. 5C, the assembly 10 comprises three LEDs 61, 62, 63 for red, green and blue light, respectively. They generate measuring signals $S_{mR}$, $S_{mG}$, $S_{mB}$, respectively, which signals are received by the controller 2. From these three measuring signals, the controller 2 calculates the color point of the light (either ambient light, or light produced by one or more other light sources) as received by the three LEDs. In a possible embodiment, the controller 2 is designed to drive the three LEDs such that their combined light has the same color point as the measured color point. As a result, the light output of the illumination system automatically matches the ambient light.

It is noted that the technology of driving three (or more) light LEDs such that their combined light has a certain desired color point by suitably setting the duty cycles of the three LEDs is known per se and needs no further explanation here.

It is noted that it may be desirable, though not essential, to assure that there are moments when all LEDs are OFF simultaneously. If the controller performs the light measurements during these moments, it is assured that the measurement of a certain LED is not affected by the light of another LED. One way of achieving this is if the current periods of the three LEDs are mutually equal and the measuring periods of the LEDs have a certain overlap. It should be clear that mutually different duty cycles are still possible this way.

It is further noted that each LED 61, 62, 63 may be driven by a separate driver, all drivers being controlled by the controller, but it is also possible that the LEDs are driven by one common driver, adapted for driving multiple LEDs independently, or adapted for driving multiple LEDs simultaneously with synchronized current periods.

Summarizing, the present invention provides a lighting device 10, comprising:

a LED 4;

a driver 3 for driving the LED;

a controller 2 for controlling the driver.

The LED is coupled to a sensor input 21 of the controller.

The controller regularly switches from a drive state to a measuring state and back.

In the measuring state, the controller controls the driver such that the driver does not generate any LED current. The LED produces a measuring signal Sm indicating a measured light level. The controller processes the input signal Sm received from the LED, and makes a decision on the desired light output of the LED.

In the drive state, the controller controls the driver such that the average light output produced by the LED corresponds to the desired light output as determined in the measuring state.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, although the above example describes duty cycle control as a possible method for varying the light output of the LED, it is also possible that the LED is driven on the basis of another known or future method, such as PWM, FM, AM, PCM of the LED current.

Further, although in the drawings the controller and driver are illustrated as separate blocks, it is noted that the controller and driver may be integrated into one device.

For instance, although in the above example the controller makes a decision on the desired light output in each measuring state, and uses this decision in the next drive state, such is not necessary. In principle, it is possible that the controller only collects measuring data during the subsequent measuring states, to be able to produce a log of measurements. It is further possible that the controller needs more time to process the measuring data, so that an adaptation of the LED driving control signal is only executed a few state cycles later. It is further possible that the controller calculates an average value of multiple measuring data, and adapts its control signal on the basis of such average.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Lighting device, comprising:

an LED;

a driver for driving the LED;

a controller for controlling the driver, the controller having a sensor input for receiving a measuring signal indicating a measured light level;

wherein the LED is coupled to the sensor input of the controller;

wherein the controller is capable of operating in a drive state and in a measuring state and is configured, during operation, to alternate between the drive state and the measuring state;

wherein, in the drive state, the controller is configured to generate a control signal for the driver such that the LED generates light; and wherein, in the measuring state, the controller is configured to generate the control signal for the driver such that the driver does not generate any LED current, and to process an input signal received from the LED as a light measuring signal; so that the LED is alternatively used for generating light and sensing light, wherein, in the measuring state, the controller is configured to make a determination on the desired light output of a LED on the basis of the input signal received from the LED; and wherein, in the drive state, the controller is configured to generate the control signal for the driver such that an average light output produced by the LED corresponds to the desired light output, as determined in the measuring state.

2. Lighting device according to claim 1, wherein, in the drive state, the controller is configured to generate the control signal for the driver such that the average LED current has a value as determined in the measuring state.

3. Lighting device according to claim 2, wherein the controller is configured to vary the LED current magnitude.

4. Lighting device according to claim 2, wherein the driver is configured to drive the LED with a nominal LED current ($I_{NOM}$); wherein, in the drive state, the controller is configured to generate its control signal for the driver such that the driver generates the nominal LED current ($I_{NOM}$); and wherein the controller is configured to vary the duration ($\tau 1$) of the drive state.

5. Automatically switching illumination system responsive to at least one other light source, comprising a lighting device according to claim 1, wherein the controller is configured, if the measuring signal (Sm) indicates that such other light source is ON, to set the average light output at a predetermined value larger than zero; and wherein the controller is configured, if the measuring signal (Sm) indicates that such other light source is OFF, to set the average light output to be equal to zero.

6. Color-sensitive illumination assembly, comprising:

a plurality of LEDs;

a driver for driving the LEDs;

a controller for controlling the driver, the controller having sensor inputs for receiving measuring signals indicating a measured light level; wherein the LEDs are coupled to the respective sensor inputs of the controller; wherein the controller, in respect of each individual LED, is capable of operating in a drive state and in a measuring state; wherein the controller, in respect of each individual LED, is configured, during operation, to alternate between the drive state and the measuring state; wherein, in the drive state for an individual LED, the controller is configured to generate the control signal for the driver such that this individual LED generates light; and wherein, in the measuring state for an individual LED, the controller is configured to generate the control signal for the driver such that the driver does not generate any LED current for said individual LED, and to process the input signal (Sm) received from said individual LED as a light measuring signal; so that one and the same individual LED is alternatively used for generating light and sensing light, wherein, in the measuring state for said individual LED, the controller is configured to make a determination on a desired light output of said individual LED on the basis of the input signal received from said individual LED; and wherein, in the drive state for said individual LED, the controller is configured to generate the control signal for the driver such that an average light output produced by said individual LED corresponds to the desired light output, as determined in the measuring state.

7. Color-sensitive illumination assembly according to claim 6, wherein the controller is configured to assure that the measuring states for all LEDs are OFF or ON within a certain time overlap.

8. Color-sensitive illumination assembly according to claim 6, wherein the desired light output corresponds to sensed ambient light.

* * * * *